US006997249B2

(12) United States Patent
Zikeli et al.

(10) Patent No.: US 6,997,249 B2
(45) Date of Patent: Feb. 14, 2006

(54) FLUID GUIDANCE PIECE WITH INTERNAL TEMPERATURE EQUALIZATION

(75) Inventors: Stefan Zikeli, Regau (AT); Friedrich Ecker, Timelkam (AT)

(73) Assignee: Zimmer A.G., Frankfurt am Main (DE)

( * ) Notice: Subject to any disclaimer, the term of this patent is extended or adjusted under 35 U.S.C. 154(b) by 33 days.

(21) Appl. No.: 10/276,757

(22) PCT Filed: Apr. 17, 2001

(86) PCT No.: PCT/EP01/04353

§ 371 (c)(1),
(2), (4) Date: Jun. 9, 2003

(87) PCT Pub. No.: WO01/88232

PCT Pub. Date: Nov. 22, 2001

(65) Prior Publication Data

US 2004/0108103 A1 Jun. 10, 2004

(30) Foreign Application Priority Data

May 18, 2000 (DE) ..... 100 24 540

(51) Int. Cl.
*F28D 7/10* (2006.01)

(52) U.S. Cl. ..... 165/154; 165/155; 285/123.15

(58) Field of Classification Search ..... 165/154, 165/155, 144; 285/123.15
See application file for complete search history.

(56) References Cited

U.S. PATENT DOCUMENTS 1,854,169 A * 4/1932 Fryhofer ..... 165/154
2,120,000 A * 6/1938 Neil ..... 165/154
2,218,097 A * 10/1940 Rhodes ..... 165/155
2,475,635 A * 7/1949 Parsons ..... 285/123.15
3,386,497 A * 6/1968 Feldmeier ..... 165/154
3,889,746 A * 6/1975 Laffranchi ..... 165/155
4,461,347 A * 7/1984 Layton et al. ..... 165/154
4,648,355 A * 3/1987 Bekedam ..... 165/154
4,740,981 A * 4/1988 Kleisle et al. ..... 165/154
4,834,172 A * 5/1989 Duran ..... 165/155
4,840,226 A * 6/1989 Richlen ..... 165/155
5,257,757 A * 11/1993 Paul et al. ..... 165/154
5,770,769 A * 6/1998 Geiger et al. ..... 562/559
6,157,778 A * 12/2000 Kadotani ..... 165/154
6,302,448 B1 * 10/2001 Van Der Meer et al. ..... 285/123.15

FOREIGN PATENT DOCUMENTS

| | | | |
|---|---|---|---|
| DE | 35 32 979 A1 | | 4/1987 |
| WO | WO 94/28213 | | 12/1994 |
| WO | WO 96/27035 | | 9/1996 |
| WO | WO 9720179 | * | 6/1997 |

* cited by examiner

*Primary Examiner*—Leonard R. Leo
(74) *Attorney, Agent, or Firm*—McDonnell Boehnen Hulbert & Berghoff LLP

(57) ABSTRACT

The present invention relates to a fluid line member for a modular fluid line system for passing therethrough a crystallizing, heat-sensitive working fluid, such as a synthetic polymer, a cellulose derivative or a solution consisting of cellulose, water and amine oxide. Such working fluids have a temperature-dependent viscosity and are subject to spontaneous decomposition phenomena under strong exothermic reaction. A temperature control of the working fluid is to be made possible by the fluid line member. This is achieved in that the fluid line member has a circular cross-section with a temperature control device instead of the core flow. According to the invention the temperature of the working fluid can thereby be controlled from the inside.

17 Claims, 2 Drawing Sheets

FLUID GUIDANCE PIECE WITH INTERNAL TEMPERATURE EQUALIZATION

The present invention relates to a fluid line member comprising a working fluid line portion designed to be flown through by a crystallizing, heat-sensitive working fluid, such as a synthetic polymer or a polymer solution, a cellulose derivative, a solution consisting of cellulose, water and amine oxide, as well as mixtures thereof.

Such fluid line members are known as simple pipes and are conventionally used in spinning facilities in which the working fluid is spun as a molding material into molded bodies. As a rule, the working fluid is transported through the fluid line member from a reaction tank in which it is blended, to a spinneret at which it is spun.

The working fluids used are heat-sensitive and tend to carry out a spontaneous exothermic reaction whenever a specific maximum temperature is exceeded in the fluid line member or when the working fluid is stored below said maximum temperature for an excessively long period of time.

The working fluids which can be used in the present invention have a very high, temperature-dependent viscosity on the whole. Their viscosity decreases with an increasing temperature and at an increased shear rate.

A working fluid that is particularly suited for spinning is a molding material which consists of a spinning solution containing cellulose, water and a tertiary amine oxide, such as N-methylmorpholine N-oxide (NMMO) as well as stabilizers for the thermal stabilization of the cellulose and the solvent and, optionally, further additives, such as titanium dioxide, barium sulfate, graphite, carboxymethyl celluloses, polyethylene glycols, chitin, chitosan, alginic acid, polysaccharides, dyes, antibacterially acting chemicals, flameproofing agents containing phosphorus, halogens or nitrogen, activated carbon, carbon blacks or electrically conductive carbon blacks, silicic acid, organic solvents as diluents, etc.

For transporting the working fluid the fluid line member must be heatable on the one hand so that the viscosity of the working fluid decreases and the working fluid can be conveyed under small losses through the fluid line member. On the other hand the temperature must not be too high to prevent a decomposition and a spontaneous exothermic reaction of the working fluid. Finally a velocity profile that is as uniform as possible should be achieved via the flow cross-section of the fluid line member flown through by the working fluid to ensure a uniform flow through the fluid line member.

For the solution of these problems EP 0 668 941 B1 suggests that the temperature in the center of the pipe and/or at the inner wall of a fluid line member should be controlled according to the formulae indicated therein. To this end a cooling medium is passed through a cooling jacket surrounding the working fluid line portion. The cooling medium carries off the heat of possibly occurring exothermic reactions from the working fluid and cools the outer portion of the fluid flow.

The fluid line system as suggested in EP 0 668 941 B1 has, however, the drawback that the efficiency achieved by the working fluid flowing therethrough is still poor and that the temperature-dependent characteristics of the working fluid can only be controlled in an inaccurate manner.

DE 35 32 979 A1 discloses an internally positioned accessory heating means for pipes. A circumflown tubular hollow body is here arranged in a substantially tubular transportation and/or conveying line, in particular of glass. The tubular hollow body is flexible and comprises a thin wall, so that it yields to possibly arising turbulence by oscillating movement. The apparatus of DE 35 32 979 A1 is e.g. suited for sulfochlorination systems where the substances conveyed through the transportation and/or conveying line are to be monitored.

In "Ullmanns Encyklopädie der technischen Chemie", $4^{th}$ ed., Vol. 2 (1972), Verlag Chemie, pages 458 and 459, the equations for the heat transfer in the case of indirect heat exchangers are indicated under section 3.2.1.3. It is stated there with respect to the basic conditions of said equations that the heat transfer can take place only on the inner pipe, only on the outer pipe, or on both pipes.

It is object of the present invention to provide a fluid line member which has an improved efficiency while the working fluid is flowing therethrough and which permits a more direct control of the temperature-dependent characteristics of the working fluid.

According to the invention this object is achieved for a fluid line member of the above-mentioned type in that the working fluid line portion has a substantially annular flow cross-section and that an internal temperature control device is arranged in the center of the fluid line member replacing the core flow of the working fluid for controlling the temperature of the working fluid within the working fluid line portion, and that a surface ratio $O=(D_I+D_A)D_{AD}$ from the sum of outer diameter $D_A$ and inner diameter $D_I$ of the annular working-fluid line portion and an adequate fluid line diameter $D_{AD}=(D_A^2-D_I^2)$ is between O=1 and O=4.

Hence, with this solution a core flow does no longer exist. Thus the temperature of the outer fluid can very well be influenced throughout the whole cross-section of the flow. The temperature control device assumes the position of the core flow, thereby permitting a control of the temperature of the working fluid from the interior of the flow. As a consequence, the working fluid and thus the temperature-dependent characteristics of the working fluid can be controlled more accurately; the flow losses can be lowered. Nor is it necessary to measure the temperature of the core flow, which is only possible in a very inaccurate and indirect manner under great efforts.

In contrast to the solution pursued in EP 0 668 941 B1, in which the core temperature can only be varied indirectly by cooling the outer temperature, the inner portion of the working fluid can thus be influenced directly with respect to its temperature through the temperature control device of the invention which the working fluid flows around.

On account of the arrangement of the temperature control device instead of the core flow of the working fluid and on account of the annular working-fluid line portion created thereby, the thickness of the flow cross-section to be temperature-controlled is also reduced: In the method of EP 0 668 941 A1 the thickness of the layer to be temperature-controlled corresponds to that of the inner diameter of the working fluid line portion. According to the invention the layer thickness of the working fluid to be temperature-controlled only corresponds to the wall thickness of the annular flow cross-section. Thanks to the reduced layer thickness the time constants for the heat transfer are reduced.

The temperature control device can be used for cooling and for heating the working fluid, depending on whether the temperature of the temperature control device is higher or lower than the temperature of the working fluid. In the fluid line member the temperature of the temperature control device can also be controlled such that specific sections of the temperature control device act as cooling sections and other sections as heating sections. The temperature of the working fluid averaged across the flow cross-section of the working fluid line portion serves as a reference temperature of the working fluid.

When the inner diameter of the fluid line member is designated by $D_A$ and the outer diameter of the temperature control device by $D_I$, $D_A$ corresponding to the outer diameter and $D_I$ to the inner diameter of the annular working-fluid line portion, and when an adequate fluid line diameter $D_{AD}$ is determined as $\sqrt{(D_A^2-D_I^2)}$, a surface ratio can be defined as follows: $O=(D_I+D_A)/D_{AD}$. This surface ratio O is between O=1 and O=4. Particularly preferably, it may be between O=1 and O=1.8.

of the annular flow cross-section. Thanks to the reduced layer thickness the time constants for the heat transfer are reduced.

The temperature control device can be used for cooling and for heating the working fluid, depending on whether the temperature of the temperature control device is higher or lower than the temperature of the working fluid. In the fluid line member the temperature of the temperature control device can also be controlled such that specific sections of the temperature control device act as cooling sections and other sections as heating sections. The temperature of the working fluid averaged across the flow cross-section of the working fluid line portion serves as a reference temperature of the working fluid.

According to a particularly advantageous design the temperature control device is designed as an inner pipe which is arranged to be coaxial to the working fluid line portion and through which a temperature control fluid is flowing. In comparison with an electrical heating a more uniform heat transfer can be achieved through a temperature control fluid without any great local differences in temperature.

The working fluid can be cooled or heated in a countercurrent flow or co-current flow by the temperature control fluid flowing through the temperature control device. With a co-current flow the directions of flow of working fluid and temperature control fluid are substantially in the same direction. With a countercurrent flow the directions of flow of working fluid and temperature control fluid are substantially in opposite directions.

In a further, particularly advantageous development of the fluid line member a temperature-control jacket section which surrounds the working fluid line portion at least sectionwise may be provided in addition to the temperature control device.

According to a particularly advantageous design the temperature control device is designed as an inner pipe which is arranged to be coaxial to the working fluid line portion and through which a temperature control fluid is flowing. In comparison with an electrical heating a more uniform heat transfer can be achieved through a temperature control fluid without any great local differences in temperature.

To keep the heat transfer between the fluid line member and its environment as low as possible, the working fluid line section may be covered at least sectionwise by a thermal insulation layer in a further advantageous development.

For achieving the objective of the invention it is important, among other things, that the working fluid flows around the temperature control device. According to a further advantageous development this is achieved in that the fluid line member comprises a spacer which extends from the temperature control device into the working fluid up to the inner wall of the working fluid line member. Depending on the respective requirements, any desired number of spacers may be provided in a respectively advantageous arrangement. A separate heating of the spacers is also possible.

To keep the flow losses as small as possible while the working fluid is flowing around the spacers, the spacers may have a substantially streamlined cross-section.

The heat transfer area can be increased once again when the temperature control fluid also flows around the spacer. As a result, the working fluid which does not come into direct contact with the temperature control device or the temperature control jacket section can also be influenced in a direct way. At the same time this solution offers a constructionally simple possibility of supplying the temperature control device with temperature control fluid.

For achieving the objective of the invention it is important, among other things, that the working fluid flows around the temperature control device. According to a further advantageous development this is achieved in that the fluid line member comprises a spacer which extends from the temperature control device into the working fluid up to the inner wall of the working fluid line member. Depending on the respective requirements, any desired number of spacers may be provided in a respectively advantageous arrangement. A separate heating of the spacers is also possible.

To keep the flow losses as small as possible while the working fluid is flowing around the spacers, the spacers may have a substantially streamlined cross-section.

The heat transfer area can be increased once again when the temperature control fluid also flows around the spacer. As a result, the working fluid which does not come into direct contact with the temperature control device or the temperature control jacket section can also be influenced in a direct way. At the same time this solution offers a constructionally simple possibility of supplying the temperature control device with temperature control fluid.

When the inner diameter of the fluid line member is designated as $D_A$ and the outer diameter of the temperature control device as $D_I$, with $D_A$ corresponding to the outer diameter and $D_I$ to the inner diameter of the annular working-fluid line portion, and when an adequate fluid line diameter $D_{AD}$ is determined as $\sqrt{(D_A^2-D_I^2)}$, the surface ratio can be defined as follows: $O=(D_I+D_A)/D_{AD}$. This surface ratio O is preferably between O=1 to O=4, particularly preferably between O=1 to O=1.8.

The ratio of the diameters $D_A$ and $D_I$ can be indicated through a working-fluid layer thickness ratio A which represents the ratio of the layer thickness $S=(D_A-D_I)/2$—in the case of a design with temperature control device (annular)—or $S=D_A$ —without a temperature control device (only outer pipe)—to the outer diameter $D_A$ of the working fluid line portion, $A=S/D_{AD}$: This ratio is preferably less than 0.5, particularly preferably less than 0.4.

As for the stability and manufacture of the fluid line member, it may be particularly advantageous when the spacer is arranged at an end of the fluid line member that is positioned in the direction of passage of the working fluid.

For the construction of a modular fluid line system the fluid line member may be provided at at least one end positioned in the direction of flow of the working fluid with a connecting section which is designed such that the fluid line member is connectable to the other fluid line members.

In a further preferred development the temperature control fluid for the temperature control device may be supplied at the connecting section. To this end the connecting section may comprise at least one temperature-control fluid opening through which the temperature control fluid can be supplied from the outside of the fluid line member to the temperature control device.

In the case of a plurality of successively connected fluid line members, a separate supply of the individual fluid line members with temperature control fluid can be omitted when the temperature control device is provided—at at least one end positioned in the direction of passage of the working fluid—with a passage opening for the temperature control fluid in the temperature control device, the passage opening being not connectable to a corresponding passage opening of a further fluid line member. In this advantageous embodiment the temperature control devices of successively connected fluid line members are connected to one another in a direct way. To this end receiving means that fit one another in a corresponding way may be provided on the respective passage openings.

In specific cases the fluid line member may have connected thereto a further fluid line member that is not provided with an internal temperature control device according to the invention. In such a case a closing means may be provided which is mountable on the passage opening for the temperature control fluid of the inner heating section and by which the passage opening can be tightly closed. The temperature control fluid is prevented by the closing means from exiting into the working fluid. To keep the flow losses as small as possible at the place of the closing means, the closing means may have a substantially streamlined outer shape in a further advantageous development. The closing means may be arranged at an end of the temperature control device that is positioned in the direction of passage or opposite to the direction of passage of the working fluid.

In the above-described developments the fluid line member may assume any functional form that is standard in line engineering.

For instance, the fluid line member of the invention may be designed as a straight pipe member or as a pipe member of any desired curvature which at each end positioned in the direction of flow of the working fluid comprises a respective connecting section for connecting two further fluid line members. With such a fluid line member the working fluid can be transported with an accurately controllable temperature profile over large distances.

The fluid line member, however, may also be designed as a distributor member equipped with at least three connecting sections for connecting further fluid line members. Such distributor members may e.g. have a Y shape, a T shape or any other three-dimensional shape.

Another possibility consists in designing the fluid line member as an end member with only on connecting section for the connection of only one further fluid line member. In this case the one passage opening for the working fluid is expediently closed as well.

The fluid line member may also be designed as a reducer whose one flow cross-section through which the working fluid is flowing is smaller at an end positioned in the direction of passage of the working fluid than at the end which is opposite in the direction of passage. Such a reducer may be used for creating transitions between different fluid line systems.

Furthermore, in another advantageous development, the fluid line member may comprise a built-in mixing reactor or tank for treating the working fluid and for varying the polymer characteristics. The fluid line member may also comprise one or several fluid filtering groups for filtering the working fluid.

The invention is not limited to a special type of temperature control fluid. For instance, liquids and gases may be used as the temperature control fluid.

Any corrosion-resistant material which is pressure-resistant with respect to possible exothermic reactions may be used as a material for the temperature control device, the working fluid line section or the temperature control jacket section. A possible material is here steel or high-quality or special steel or chromium-plated steel or high-quality steel. To minimize adhesion and friction of the working fluid on the walls, the outer wall of the temperature control device or the inner wall of the working fluid line portion may be treated to be particularly smooth or may be provided with a friction-minimizing coating.

The invention further relates to a modular fluid line system which is composed of at least two series-connectable fluid line members according to one of the above-described embodiments. The fluid line system may further comprise a controller or shut-off device which serves to control the working fluid. The controller or shut-off device may be fed via the temperature-control fluid supply system.

For retrofitting existing fluid line systems or for installation in conventional fluid conducting pipes the temperature control device may be constructed as a separate member which may have secured thereto a conventional fluid line member or a standard conduit pipe. To this end the temperature control device comprises a connecting means which is connectable to a connecting means of a further temperature control module or a further fluid line member and to which the fluid line member is tightly securable at the same time. The temperature control device assumes the position of the core flow in the fluid conducting pipe so that a substantially annular flow cross-section in the manner of a thin layer is obtained between the temperature control device and the retrofitted fluid conducting pipe.

The invention will now be described in the following with reference to embodiments taken in conjunction with the figures, of which:

Figure 1:
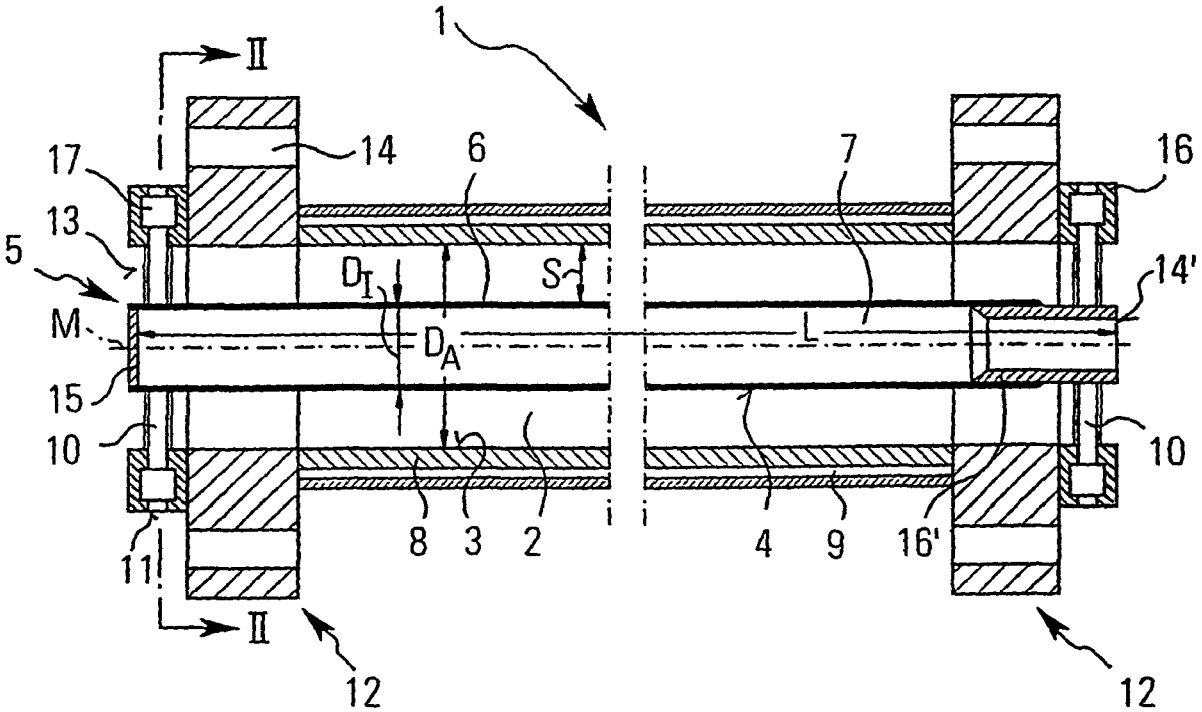
FIG. 1 shows a first embodiment of a fluid line member in longitudinal section.

FIG. 1 shows a first embodiment of a fluid line member 1 of the invention in a longitudinal section taken along a center line M of the fluid line member 1. The fluid line member 1 is of a substantially tubular structure and is rotationally symmetrical around the center axis M. The fluid line member of FIG. 1 is specifically designed for passing a spinning solution as a working fluid therethrough, the spinning solution containing water, cellulose and tertiary amine oxide. The working fluid is passed through a working fluid line portion 2 having an annular flow cross-section. The working fluid line portion has an outer wall 3 and an inner wall 4 which define the flow cross-section of the working fluid line portion 2.

The inner wall 4 of the working fluid line portion 2 is formed by a temperature control device 5.

The temperature control device 5 comprises a line section or inner body 6 which is designed to be coaxial with respect to the working fluid line portion 2 and has an inner chamber 7 through which a temperature control fluid is flowing. The inner body 6 is of a substantially tubular structure.

The temperature control device 5 is circumflown on the outside by the working fluid in the working fluid line portion 2. Since the temperature of the temperature control fluid in the inner chamber 7 of the temperature control device 5 has a temperature differing from that of the working fluid in the working fluid line portion 2, heat is exchanged through the wall of pipe 6. Depending on whether the temperature of the temperature control fluid is higher or lower than the temperature of the working fluid, heat is exchanged from the working fluid to the temperature control fluid or from the temperature control fluid to the working fluid.

Thus the temperature control device can be used for heating and for cooling the working fluid.

The outer wall 3 of the working fluid line portion 2 is formed by a tubular body 8 which constitutes a temperature-control jacket section. To this end the pipe 8 is surrounded by a cavity 9 around which a temperature control fluid may also flow. Irrespective of the temperature of the temperature control fluid in the temperature control device 5 the temperature of the temperature control fluid in the temperature-control jacket section 9 can be higher or lower than the temperature of the working fluid. Thus the outer wall 3 can be used for cooling or heating the working fluid independently of the temperature control device 5.

The temperature-control jacket section is provided with connections for the supply of temperature control fluid. The temperature control fluid is fed to the temperature-control jacket section 9 at a predetermined controllable temperature.

The temperature control device 5 is supplied with temperature control fluid via radially extending feed lines 10 which terminate in passage openings 11.

The passage openings 11 are arranged on a flange-like connecting section 12 of the fluid line member 1. The connecting section 12 serves to connect the fluid line member 1 to further fluid line members (not shown). The working fluid is here flowing through an annular passage opening 13 from one fluid line member to the other one.

The connecting section may e.g. be provided with passage or thread openings 14 through which a fluid- and compression-proof connection can be established by means of screws with the connecting section of a further fluid line member.

For the purpose of explaining various variants of supplying temperature control fluid the fluid line member of FIG. 1 is shown on the temperature control device 5 with different connecting sections at the two ends positioned in the direction of passage of the working fluid, i.e. in the direction of the center axis M.

At the left end shown in FIG. 1, the section for feeding the temperature control device with temperature control fluid is firmly connected to the temperature control device 5.

In FIG. 1, a closing means 15 by which the passage opening for the temperature control fluid into the temperature control device 5 is closed is provided at the end of pipe 6 of the temperature control device 5.

At the end of the fluid line member 1 which is the right one in FIG. 1, a different variant of the connecting section 12 or the feeding of the temperature control fluid into the temperature control device 5 is shown. Instead of a feed means that is integrally connected to the temperature control device 5, the feed means at the right end of the fluid line member 1 forms a separate feed module or a separate fastening body 16. The feed module 16 is provided with a line section 16' which is tightly connectable to the temperature fluid line 6 of the temperature control device 5. In the embodiment of FIG. 1 this is accomplished in that the line section 16' is pushed into the line or inner body 6. The interior 7 of the temperature control fluid line 6 is connected via line section 16 to the feed lines 10 of the feed module 16 that extend radially or in spoke-like fashion.

The feed lines 10 of the fastening body 16 end in passage openings 11 that are connected to a temperature-control fluid supply (not shown).

The temperature-control fluid supply, which is not shown in the figures, conveys the temperature control fluid through the temperature control device 5 and simultaneously controls the temperature of the temperature control fluid in response to predetermined process parameters, such as the composition of the working fluid, the feed rate of the working fluid, the mass flow of the working fluid, or the like.

Different temperature-control fluid supply systems may be provided for the supply of the temperature-control jacket section 9 and the temperature control device 5.

In the embodiment shown in FIG. 1, a surface ratio $O=(D_I+D_A)/D_{AD}$ which is formed from the quotient of the sum of the outer diameter $D_A$ and the inner diameter $D_I$ of the working fluid line section 2 and an adequate fluid line diameter $D_{AD}=\sqrt{(D_A^2-D_I^2)}$ is preferably between O=1 to O=4, particularly preferably between O=1 to O=1.8.

The ratio $A=S/D_{AD}$ of the layer thickness $S=(D_A-D_I)/2$ to the adequate fluid line diameter $D_{AD}$ of the working fluid line portion 2 is preferably less than 0.5; in the embodiment of FIG. 1 less than 0.4.

Figure 2:
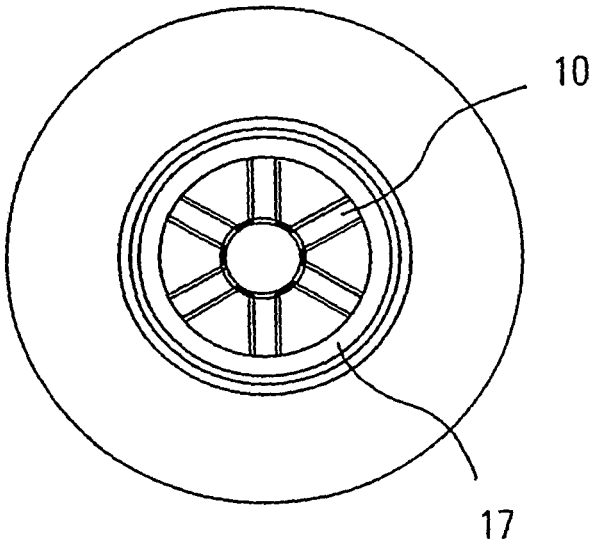
FIG. 2 shows the fluid line member of FIG. 1 in cross section.

FIG. 2 shows a cross section perpendicular to the center line M along line II—II of FIG. 1.

As can be seen in FIG. 2, the feed lines 10 extend in straight fashion in radial direction and are arranged in star-like configuration. The number of the feed lines is arbitrary, also their arrangement. To avoid dead water zones behind the feed lines, the cross section thereof is of a streamlined configuration in the direction of passage of the working fluid.

In FIG. 2 feed lines 10 are connected to form an annular chamber 17. Said annular chamber 17 may be connected via one or several connections to the temperature-control fluid supply system (here not shown).

The closing means 14 is used whenever the temperature control devices 5 of successive fluid line members are to be isolated from one another.

This may e.g. serve to keep the temperature drop small along the direction of flow of the temperature control fluid within the temperature control device 5 or to heat or cool successive fluid line members in alternate fashion.

The direction of flow of the temperature control fluid in the temperature control device 5 may be in the same direction or in a direction opposite to the direction of the flow passing through the working fluid line section 2, i.e. in a co-current flow or in a countercurrent flow.

Figure 3:
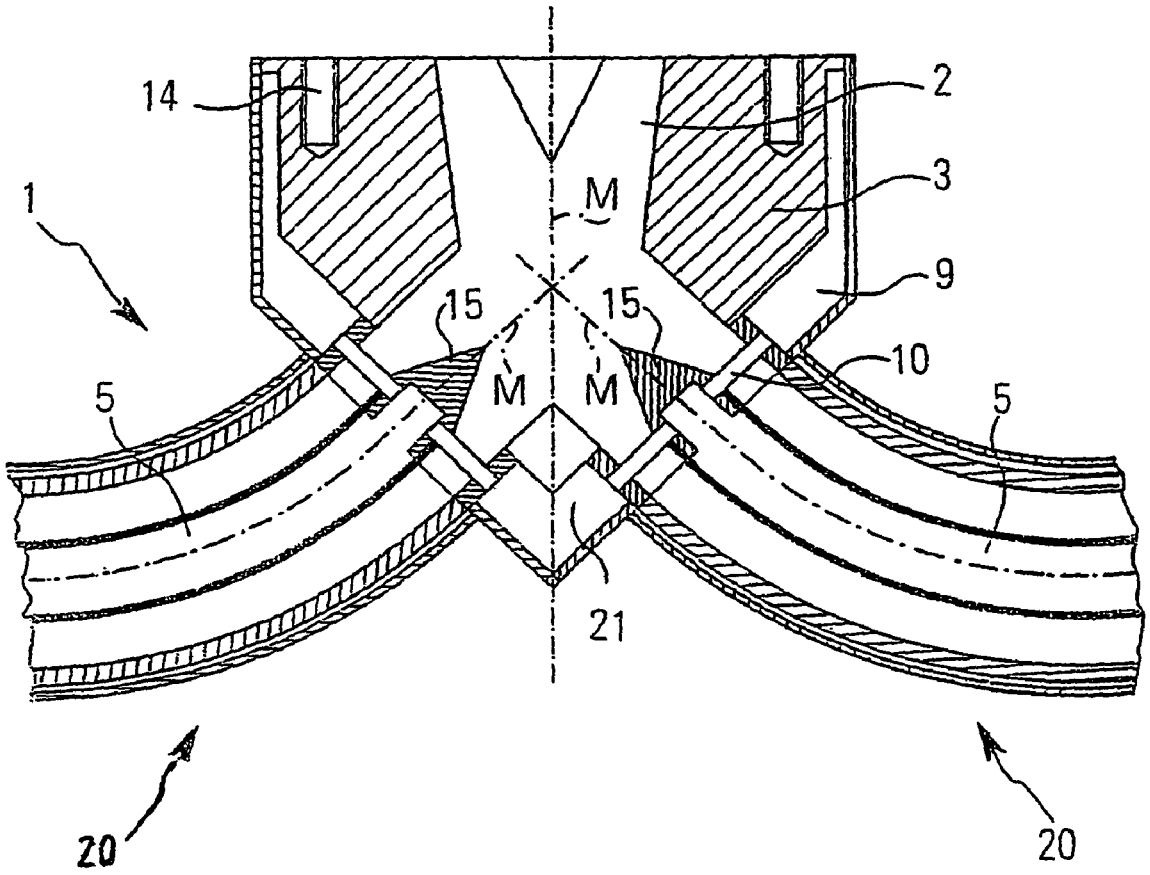
FIG. 3 shows a second embodiment of the fluid line member according to the invention.

FIG. 3 shows a second embodiment of a fluid line member 1 according to the invention. In this embodiment the same reference numerals are used for elements fulfilling the same or a similar function as in the embodiment of FIG. 1.

The fluid line member of FIG. 3 is designed as a distributor member configured in Y shape. The embodiment of FIG. 3 may also be in the form of any other desired distributor member, e.g. in T form or in any desired three-dimensional form.

In the embodiment of FIG. 3, the distributor member is provided with two curved pipe sections 20 which end in connecting sections 12 according to one of the variants shown in FIG. 1. With specific applications the interposition of a pipe member may be dispensed with. In such a case the connecting sections 12 directly rest on the distributor member 1.

The distributor-member 1 is provided on the outside with a temperature-control jacket section 9 which surrounds an outer wall 8 of the working fluid line section 2. The temperature-control jacket section 9 is connected in the case of the distributor member of FIG. 3 via feed lines 8 to the temperature control device 5.

The distributor member 1 is connected to a total of three fluid line members (not shown). In the area where the working fluid line portions are branched off, no temperature control devices 5 are mounted so as not to block the flow of the working fluid therethrough. The temperature control devices 5 of the two pipe sections 20 end in front of the point of intersection of the respective center lines M of the corresponding fluid line member. To achieve an advantageous flow which is as free as possible from losses in the area of the ends of the temperature control devices 5 and to avoid the formation of stagnation zones in which the working fluid might degrade, the closing members 14 are streamlined, i.e. made conical in the instant case. Such a design achieves a clear-cut division of the flow of the working fluid in the distributor member 1. An exchange of temperature control fluid of the temperature control devices 5 of the two pipe sections 20 takes place via section 21 of the temperature-control jacket section 9.

What is claimed is:

1. A modular fluid line system adapted for transporting a working fluid comprising:

at least two series-connectable fluid line members having a working-fluid-line portion adapted to transport said working fluid and having a substantially annular flow cross-section;

said annular flow cross-section having an outer diameter ($D_A$), an inner diameter ($D_I$), a fluid line diameter $D_{AD}=\sqrt{(D_A^2-D_I^2)}$ and a surface ratio $O=(D_I+D_A)/D_{AD}$ between O=1 and O=4;

an internal temperature control device arranged in the center of said fluid line member and adapted to control the temperature of said working fluid in said annular flow cross-section; and a plurality of spacers extending radially from said temperature control device to said outer wall of said working fluid line portion through said annular flow cross-section, the internal temperature control device being designed as a tubular temperature-control fluid line adapted to transport a temperature control fluid wherein a feed line is provided, said feed line extending in said spacers and supplying said temperature control fluid to said temperature control device from outside said fluid line member.

2. The modular fluid line system according to claim 1, wherein the plurality of spacers have a substantially streamlined cross-section.

3. The modular fluid line system according to claim 1, wherein the spacers are provided on a separate feed module.

4. The modular fluid line system according to claim 1, wherein at least one end of said internal temperature control device comprises a passage opening for said temperature control fluid, said end being positioned in the direction of passage of the working fluid, the passage opening being connectable to a corresponding passage opening of a further fluid line member via said feed lines.

5. The modular fluid line system according to claim 1, wherein said spacers are provided on a separate feed module having a line section that is tightly connectable to said temperature control fluid line.

6. The modular fluid line system according to claim 1, wherein said spacers are arranged in a star-like configuration.

7. The modular fluid line system according to claim 6, wherein said spacers are heated separately.

8. A modular fluid line system adapted for transporting a working-fluid comprising:

at least two series-connectable fluid line members having a working fluid-line portion that is adapted to have said working fluid flow through it and having a substantially annular flow cross-section, an internal temperature control device for controlling the temperature of the working fluid within said annular flow cross-section, said internal temperature control device arranged in the center of said at least one fluid line member, said internal temperature control device being adapted to transport a temperature control fluid, and a separate feed module adapted to be connectable at an end of said fluid line members between said two series-connectable fluid line members in a direction of passage of said working fluid and to be further connectable to said internal temperature control device, said separate feed module having feed lines, said feed lines transporting said temperature control fluid to said internal temperature control device from outside said fluid line members.

9. The modular fluid line system according to claim 8, wherein said internal temperature control device is designed as a tubular temperature control fluid line adapted for transporting said temperature control fluid.

10. The modular fluid line system according to claim 8, wherein said separate feed module further comprises a line section connectable to said temperature control device and connecting the interior of said temperature control device to said feed lines to supply said temperature control fluid.

11. The modular fluid line system according to claim 8, wherein said separate feed module further comprises one or a plurality of spacers extending from said temperature control device through said annular flow cross-section to an outer wall of said working fluid line portion.

12. The modular fluid line system according to claim 11, wherein a plurality of spacers is provided that extend radially from said internal temperature control device.

13. The modular fluid line system according to claim 10, wherein said spacer has a substantially streamlined cross-section.

14. The modular fluid system according to claim 11, wherein said feed line extends through said spacer.

15. The modular fluid line system according to claim 10, wherein a flange-like connecting section is provided on said fluid line members, said connecting section having at least one temperature-control fluid opening through which temperature control fluid can be supplied from outside of said fluid line member to said feed lines, said connecting section connecting two of said fluid line members and providing an annular passage opening for said working fluid from one fluid line member to the other.

16. The modular fluid line system according to claim 10, wherein at least one end of_said internal temperature control device, said end being located in a direction of transport of said working fluid through said temperature control device, comprises a passage opening for the temperature control fluid in said temperature control device, said passage opening being tightly connectable to a corresponding passage opening of a further fluid line member.

17. A temperature control device designed to be installable in a fluid line member of a modular fluid line system for passing therethrough a working fluid, said fluid line member comprising a working fluid line portion through which said working fluid is flowing, said temperature control device comprising:

a connecting means which is connectable to a connecting means of a further temperature control device or a further fluid line member, said connecting means comprising spacers locating said temperature control device at the position of a core flow of said working fluid line portion, said spacers extending radially, said connecting means being formed as a separate body, said spacers being provided with feed lines extending in said spacers, said feed lines terminating in a temperature control fluid passage and connecting said temperature control fluid passage to the interior of said temperature control fluid line, said temperature control device being designed as a tubular temperature-control fluid line adapted to transport a temperature control fluid.

* * * * *